US009446444B2

(12) United States Patent
Christensen et al.

(10) Patent No.: US 9,446,444 B2
(45) Date of Patent: Sep. 20, 2016

(54) APPARATUS AND METHOD FOR SYNCHRONIZED MULTI-STAGE ELECTROMAGNETIC RIVET GUNS

(71) Applicant: The Boeing Company, Chicago, IL (US)

(72) Inventors: Tyler Christensen, Snoqualmie, WA (US); Branko Sarh, Huntington Beach, CA (US); James A. Grossnickle, Seattle, WA (US)

(73) Assignee: The Boeing Company, Chicago, IL (US)

( * ) Notice: Subject to any disclaimer, the term of this patent is extended or adjusted under 35 U.S.C. 154(b) by 141 days.

(21) Appl. No.: 14/464,951

(22) Filed: Aug. 21, 2014

(65) Prior Publication Data

US 2016/0052042 A1 Feb. 25, 2016

(51) Int. Cl.

| | |
|---|---|
| ***B21J 15/28*** | (2006.01) |
| ***B21J 15/24*** | (2006.01) |
| ***B21J 15/04*** | (2006.01) |
| ***B21J 15/02*** | (2006.01) |

(52) U.S. Cl.

CPC ..... *B21J 15/28* (2013.01); *B21J 15/02* (2013.01); *B21J 15/04* (2013.01); *B21J 15/24* (2013.01); *Y10T 29/4976* (2015.01); *Y10T 29/4995* (2015.01); *Y10T 29/49769* (2015.01); *Y10T 29/49776* (2015.01); *Y10T 29/49833* (2015.01); *Y10T 29/49943* (2015.01); *Y10T 29/49945* (2015.01); *Y10T 29/5303* (2015.01); *Y10T 29/53039* (2015.01); *Y10T 29/53052* (2015.01); *Y10T 29/53065* (2015.01); *Y10T 29/5377* (2015.01)

(58) Field of Classification Search

CPC ..... B21J 15/28; B21J 15/04; B21J 15/02; B21J 15/24; Y10T 29/5377; Y10T 29/53052; Y10T 29/53065; Y10T 29/53039; Y10T 29/5303; Y10T 29/4995; Y10T 29/49833; Y10T 29/49945; Y10T 29/49943; Y10T 29/49769; Y10T 29/49776

See application file for complete search history.

(56) References Cited

U.S. PATENT DOCUMENTS

| | | | | |
|---|---|---|---|---|
| 5,259,104 | A | 11/1993 | Givler | |
| 5,379,508 | A | 1/1995 | Givler et al. | |
| 5,398,537 | A | 3/1995 | Michalewski et al. | |
| 2002/0172576 | A1 | 11/2002 | Keener | |
| 2008/0170926 | A1* | 7/2008 | Taylor | B21J 15/043 411/43 |

FOREIGN PATENT DOCUMENTS

| | | | |
|---|---|---|---|
| EP | 0293257 | A2 | 11/1988 |
| EP | 0768128 | A1 | 4/1997 |
| WO | 2004012881 | A1 | 2/2004 |
| WO | 2013152440 | A1 | 10/2013 |

OTHER PUBLICATIONS

Extended European Search Report, European Patent Application No. 15177980.8 dated Jan. 15, 2016.

* cited by examiner

*Primary Examiner* — John C Hong

(74) *Attorney, Agent, or Firm* — McDonnell Boehnen Hulbert & Berghoff LLP

(57) ABSTRACT

A method and system for installing rivets is disclosed. The method involves positioning a rivet through a structure to be joined. The method further involves positioning a first rivet gun on a first side of the rivet and positioning a second rivet gun on a second side of the rivet. The method also involves synchronizing firing of the first and second rivet guns, so as to cancel forces that otherwise would propagate into the structure during installation of the rivet.

20 Claims, 7 Drawing Sheets

APPARATUS AND METHOD FOR SYNCHRONIZED MULTI-STAGE ELECTROMAGNETIC RIVET GUNS

BACKGROUND

Unless otherwise indicated herein, the materials described in this section are not prior art to the claims and are not admitted to be prior art by inclusion in this section.

In the aerospace industry, structural fasteners such as rivets are commonly used to join a structure such as metal sheet components. In an example, rivets are used for construction of primary structures of aircraft (e.g., fuselage, wings, and tail), as well as secondary structures (e.g., rudders). Rivets commonly are used for fastening an aerodynamic skin to a frame to provide a strong aerodynamically smooth surface. Further, rivets are also commonly used in the interior structure of aircrafts since rivets provide a light and secure method of fastening structural components together.

Before being installed, a rivet typically consists of a cylindrical shaft with a head on one end and a tail on the other end (commonly referred to as the buck-tail). The installation process for installing rivets to join a structure typically involves use of a rivet gun and a bucking bar. In particular, a typical rivet-installation process involves forming a hole in the structure and then placing the rivet in the rivet hole. The rivet gun is placed on one side of the rivet and the bucking bar is placed on the opposite side of the rivet. The rivet gun then hammers on the rivet and some of the force of the rivet gun is absorbed by the bucking bar. Under this force, each end of the rivet is compressed causing outward expansion of the rivet such that the rivet fills the rivet hole. Typically, the rivet is compressed until the rivet establishes a tight fit, which is commonly called an interference fit. Further, during installation, the tail is deformed, so that it expands (e.g., to about 1.5 times the original shaft diameter), thereby securely holding the rivet in place.

A rivet is typically sized for the thickness of the structure which it is to join and the stress which it is to carry. Further, the impact energy of the rivet gun is typically designed to completely form the button end on the tail of the rivet and cause the desired degree of interference between the rivet shank and the hole, and/or between the rivet head and the surface of the structure.

However, the typical rivet-installation process has a number of drawbacks. For instance, the typical rivet-installation process creates impact energy that propagates through not only the rivet but also the structure into which the rivet is being installed. In practice it is extremely difficult to precisely control the propagation of the impact energy throughout the system. The lack of control over the propagation of the impact energy throughout the system may lead to a rivet that fails to meet the desired degree of interference. In the typical rivet-installation process, when a rivet gun impacts a rivet, the impact energy creates an impact wave that travels through the rivet and hits the bucking bar. Much of this impact energy is transferred to the rivet thereby leading to the deformation of the rivet. However, the impact energy of the rivet gun is also transferred or dissipated in various other ways. For example, typically some of the impact energy is lost (e.g., as heat), some of the impact energy is transferred to the bucking bar, some of the impact energy is transferred to the rivet, and some of the energy is transferred to the structure being joined. Since it is difficult to precisely control the propagation of this impact energy, an undesired amount of energy may be transferred to the structure and/or the rivet. Thus, the traditional rivet-installation process often results in rivets that fail to precisely meet a desired degree of interference.

Another drawback of the traditional rivet-installation process is that the typical rivet installation process involves a large amount of human feedback. For instance, the typical rivet process involves a highly skilled operator to produce quality rivets consistently. Further, the typical rivet process involves highly skilled quality control inspectors to confirm that installation of rivets meet particular specifications of flushness, interference and button formation.

Yet another drawback of the traditional rivet-installation process is that the typical rivet installation process is unsuitable for joining structures such as composite materials. In the aerospace industry, the use of components including composite materials is widespread. However, currently it is extremely difficult to use rivets to join composite materials, due to the forces that the traditional rivet process imparts on the composite material. As mentioned above, the impact energy created by the rivet gun is often transferred to the structure to be joined. Since composite materials typically cannot sustain the forces of the standard rivet-installation process, rivets are not commonly used to join composite materials.

BRIEF SUMMARY

A method and system for installing rivets is disclosed. An example method involves positioning a rivet through a structure to be joined. The method further involves positioning a first rivet gun on a first side of the rivet and positioning a second rivet gun on a second side of the rivet. Still further, the method involves synchronizing firing of the first and second rivet guns, so as to cancel forces that otherwise would propagate into the structure during installation of the rivet.

In an example embodiment, a riveting system includes a first rivet gun and a second rivet gun, said first rivet gun and said second rivet gun configured for operation on opposite sides of a rivet to be installed to join a structure. The riveting system further includes a controller, said controller configured to synchronize firing of the rivet guns such that forces that otherwise would propagate into the structure are canceled.

In another example embodiment, a riveting system includes a first rivet gun, a second rivet gun, and a controller. The first rivet gun and the second rivet gun are arranged on opposite sides of a rivet to be installed. Further, the controller is configured to cause the first and second rivet guns to impact the rivet a plurality of times. The controller is also configured to control a timing of each impact of the first and second rivet guns such that each impact of the first rivet gun occurs at substantially the same time as a respective impact of the second rivet gun.

The features, functions, and advantages can be achieved independently in various embodiments of the present disclosure or may be combined in yet other embodiments in which further details can be seen with reference to the following description and drawings.

DETAILED DESCRIPTION

Figure 1:
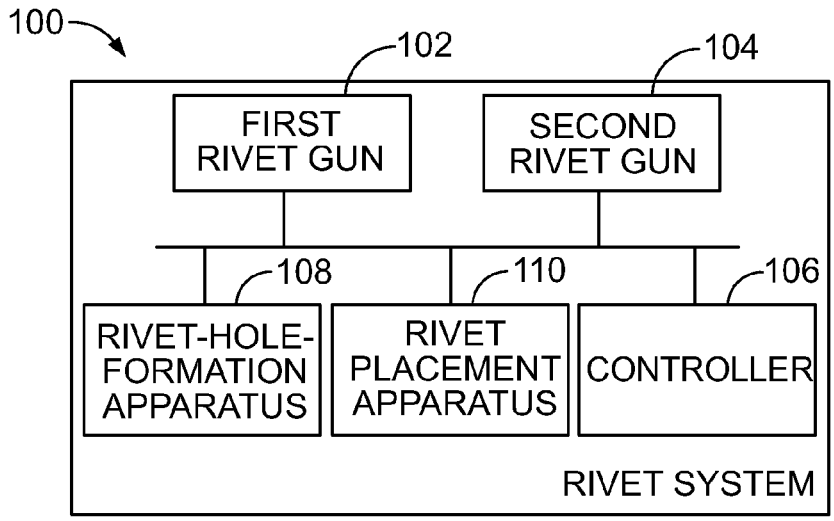
FIG. 1 is a simplified block diagram of a rivet system in accordance with an exemplary embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

1. Overview of Example Methods and Systems

As mentioned above, a traditional rivet-installation process has a number of drawbacks. For instance, the typical rivet-installation process creates impact energy that propagates through the system, and in practice it is extremely difficult to precisely control the propagation of the impact energy throughout the system. The lack of control over the propagation of the impact energy throughout the system may impact the structure into which a rivet is installed and/or result in a rivet that fails to meet the desired degree of interference. Thus, the disclosed embodiments provide an improved rivet process that does not impact the structure and that provides the ability to more precisely control the degree of interference.

The methods and systems in accordance with the present disclosure beneficially provide such a rivet process. An example method and system in accordance with the present disclosure involves fine-tuning the timing of the firing of rivet guns placed on opposite sides of the rivet, and also fine-tuning the force upon which the rivet guns impact or act on the rivet.

In particular, an example method in accordance with the present disclosure includes positioning a rivet through a structure to be joined. The method further includes positioning a first rivet gun on a first side of the rivet and positioning a second rivet gun on a second side of the rivet. Still further, the method includes synchronizing firing of the first and second rivet guns, so that forces that otherwise would propagate into the structure during installation of the rivet are canceled. In an example embodiment, each rivet gun includes a firing tube and a projectile within the firing tube, and the velocity of the projectile affects the force at which the rivet gun impacts the rivet and/or when the force of the rivet gun impacts the rivet. In an example, the method involves adjusting a velocity of the projectile in each rivet gun, so that the projectile in the first rivet gun and the projectile in the second rivet gun cause the rivet guns to impact the rivet at substantially the same time (e.g., within microseconds or milliseconds of each other).

When a rivet gun impacts a rivet on a first end, an impact wave is sent through the rivet material to the second end of the rivet. In an example embodiment, the method involves impacting the rivet on the second end at the same time or substantially the same time that the impact wave has reached the second end of the rivet. By impacting the second end of the rivet at the same time as when the impact wave reaches that second end, the well-timed second impact cancels forces that would otherwise propagate into the surrounding system (e.g., to the rivet gun and/or the structure). In particular, by timing the second impact on the second end in this way, the second impact creates a second impact wave that cancels the first impact wave traveling through the rivet. Through these well-timed impacts, all or substantially all of the energy in turn goes into deforming the rivet.

Beneficially, the disclosed methods and systems allow for precise control of the interference during rivet installation, and the disclosed methods and systems also reduce or eliminate the forces that would otherwise propagate into the structure. In particular, since the disclosed methods and systems may result in all or substantially all of the energy going into deforming the rivet, it is possible to precisely control the interference during rivet installation. Further, through these well-timed opposing impacts, forces that would otherwise propagate into the structure are canceled.

2. Example Rivet System

FIG. 1 is a simplified block diagram of a rivet system in accordance with an exemplary embodiment and in which an exemplary embodiment of the present method can be implemented. It should be understood, however, that this and other arrangements and processes described herein are set forth for purposes of example only, and that other arrangements and elements (e.g., machines, interfaces, functions, orders of elements, etc.) can be added or used instead and some elements may be omitted altogether. Further, those skilled in the art will appreciate that many of the elements described herein are functional entities that may be implemented as discrete components or in conjunction with other components, in any suitable combination and location.

The rivet system 100 of FIG. 1 includes by way of example a first rivet gun 102 and a second rivet gun 104. The rivet system 100 includes a controller 106 that is in communication with the first rivet gun 102 and the second rivet gun 104. The rivet guns are configured for operation on opposite sides of a rivet to be installed to join a structure. Further, controller 106 is configured to control the operation of the first and second rivet guns, such as precisely controlling the firing of the rivet guns.

Figure 2A:
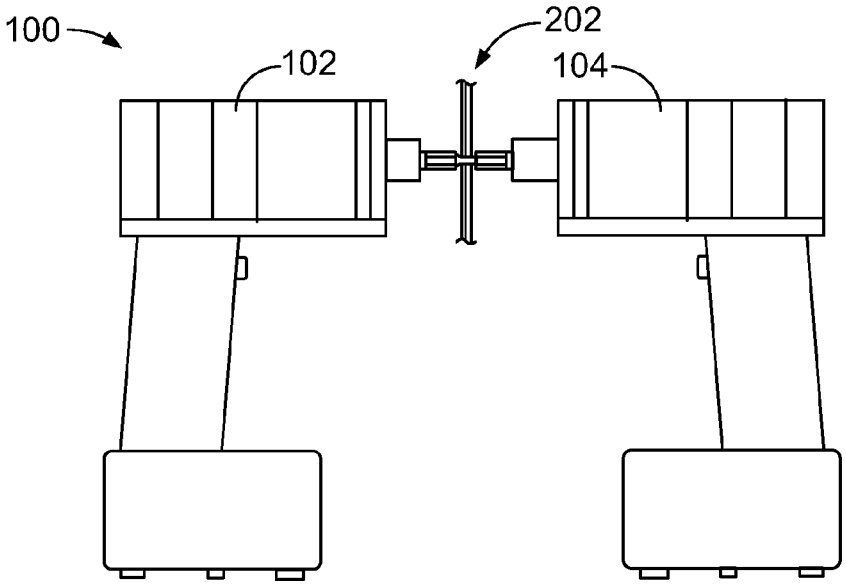
FIG. 2*a* is a depiction of the rivet guns operable in a rivet system such as that depicted in FIG. 1.
Figure 2B:
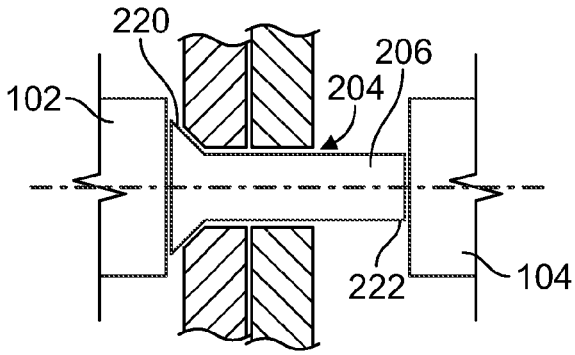
FIG. 2*b* is a close-up view of a section of the rivet guns depicted in FIG. 2*a*.

FIG. 2*a* is next a side view depiction of rivet gun 102 and rivet gun 104 arranged on opposite sides of a structure to be joined, and FIG. 2*b* provides a close-up view of the structure. As seen in FIG. 2*a*, rivet gun 102 is positioned on a first side of a structure 202, whereas rivet gun 104 is positioned on the opposite side of the structure. Structure 202 may be any structure to be joined by rivets. The structure includes two or more components to be joined. For instance, structure 202 is depicted in FIG. 2*b* as two components (e.g., metallic components). Further, as shown in FIG. 2*b*, the structure 202 includes a rivet hole 204. The rivet system 100 is configured to install a rivet such as rivet 206 to join structure 202.

In an example embodiment, the rivet system 100 also has additional components that are used during the rivet-installation process, such as a rivet-hole-formation apparatus 108 and a rivet-placement apparatus 110. Systems that combine rivet-hole formation, rivet placement, and rivet installation are commonly used in the aerospace industry because of the large number of holes and rivets required to assemble aircraft structures such as the aircraft skin. The rivet-hole-formation apparatus 108 may include any suitable apparatus for forming a rivet hole. In an example, rivet-hole-formation apparatus 108 is a drill or punching apparatus. In an example, the rivet-hole-formation apparatus 108 is configured to form countersunk holes for the installation of countersunk rivets. For instance, hole 204 is depicted as a countersunk hole. The rivet-placement apparatus 110 may include any suitable apparatus for placing or positioning rivets. In an example, the rivet-placement apparatus 110 is a robotic assembly that includes one or more robotic arms that are configured to place rivets in formed rivet holes.

As depicted in FIG. 1, the rivet-hole-formation apparatus 108 and a rivet-placement apparatus 110 are in communication with controller 106. In another example, controller 106 is a controller for the first and/or second rivet gun, and one or more other controllers is used for controlling the other rivet-system components.

In an example, the rivet system 100 is a robotic-assembly system configured for the manufacturing of aircraft structures, such as primary aircraft structures (e.g., fuselage, wings, and tail) and/or secondary aircraft structures (e.g., rudders). It should be understood, however, that although this rivet system 100 is described primarily with reference to the riveting of aircraft structures, the rivet system 100 is suitable for other types of structures as well, such as building structures, bridge components, and other structures that are suitable for joining through riveting.

Figure 6:
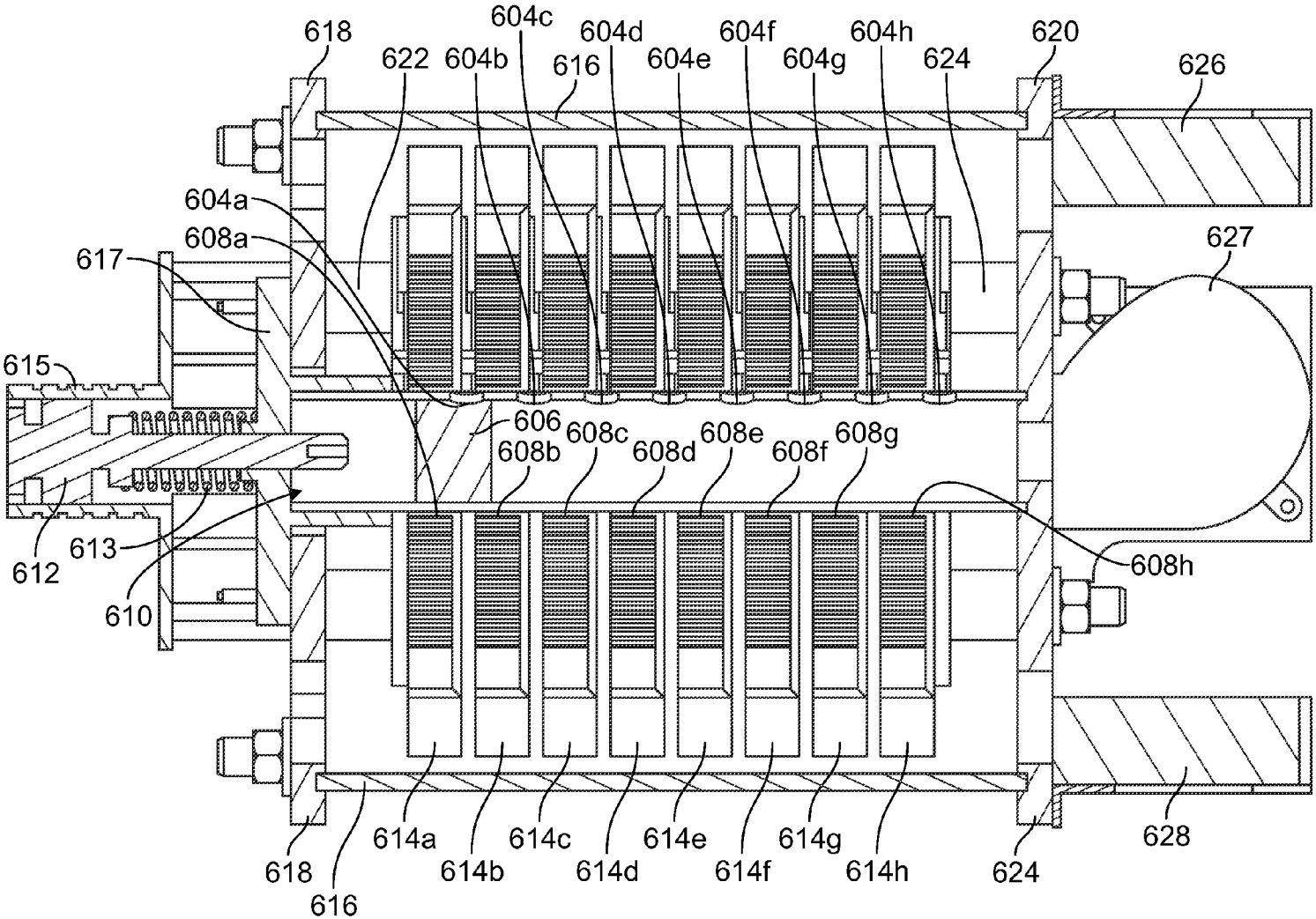
FIG. 6 depicts a cross section of an example rivet gun such as a rivet gun depicted in FIG. 2.

FIG. 6 illustrates a cross section of an example rivet gun. In particular, FIG. 6 illustrates a cross section of rivet gun 104. This figure illustrates an example firing tube 602 that includes projectile 606 and is surrounded by a plurality of electromagnetic coils 608*a-h*. Each of coils 608*a-h* is held in a respective coil module 614*a-h*. A spring-loaded hammer 612 is positioned at the end 610 of the firing tube 602. As explained below, this hammer 612 serves to impact and thereby deform a rivet. Further, hammer 612 is connected to or otherwise coupled to recoil spring 613. Still further, hammer 612 is enclosed by a housing, such as nozzle 615. A disc such as disc 617 is positioned at the interface between the firing tube 602 and the hammer 612. Further, in this example, one end of the recoil spring 613 is connected to the disc 617 whereas the other end is connected to a portion of hammer 612. As such, when projectile 606 impacts the hammer, the projectile 606 urges the hammer 612 in a first direction to impact a rivet, and recoil spring 613 then urges the hammer back in the opposite direction.

FIG. 6 also illustrates an example plurality of optical sensors 604*a-h* disposed with respect to firing tube 602. As explained below, these optical sensors detect the travel of the projectile 606 through the firing tube 602.

Figure 7:
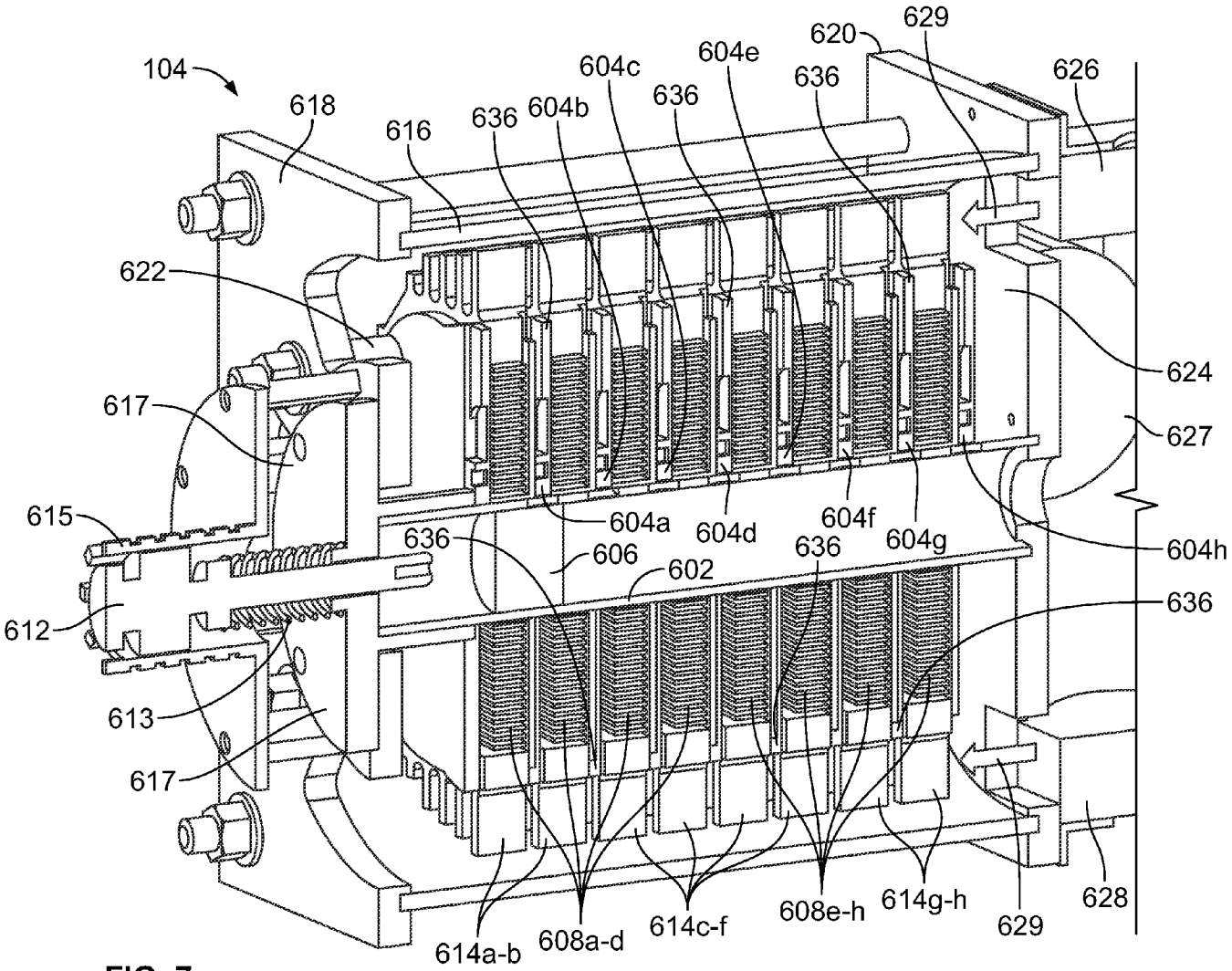
FIG. 7 depicts a cross-sectional perspective view of the rivet gun shown in FIG. 6.

As shown in FIGS. 6-7, the firing tube 602 and coil modules 614 are enclosed in a housing. For instance, FIG. 6 illustrates enclosure 616 and rivet-gun housing plates 618 and 620 surrounding the coil modules 614*a-h* and firing tube 602. Further, in an example, the rivet gun also includes a compression ring disposed between the housing plates and the coil modules. For instance, FIGS. 6-7 illustrate (i) compression ring 622 between housing plate 618 and coil module 614*a* and (ii) compression ring 624 between housing plate 620 and coil module 614*h*.

The assembly system may run continuously over long periods of time. Therefore, in an example, the rivet system 100 includes a cooling system that allows for cooling the rivet guns 102, 104 and/or other components of rivet system 100. In an example embodiment, the first and second rivet guns are air-cooled rivet guns. In an example, the rivet guns are constructed of heat-sink clamps, which allow the rivet guns to be air-cooled and not require water lines in a factory installation. In another example, the rivet guns are water-cooled or peltier-cooled. Other cooling systems are possible as well.

Figure 8:
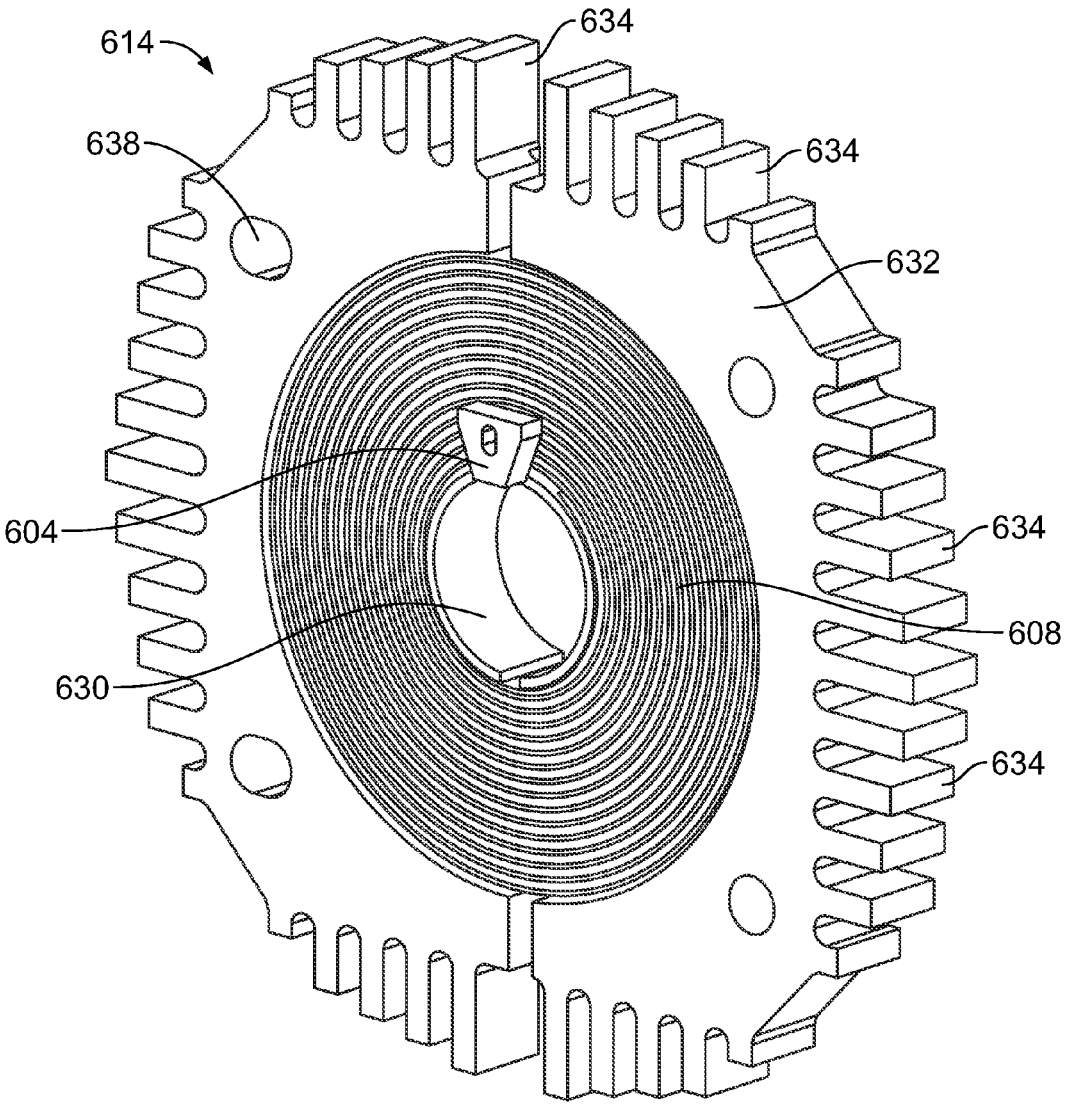
FIG. 8 depicts a perspective view of an example coil module of the rivet gun depicted in FIG. 6.
Figure 9:
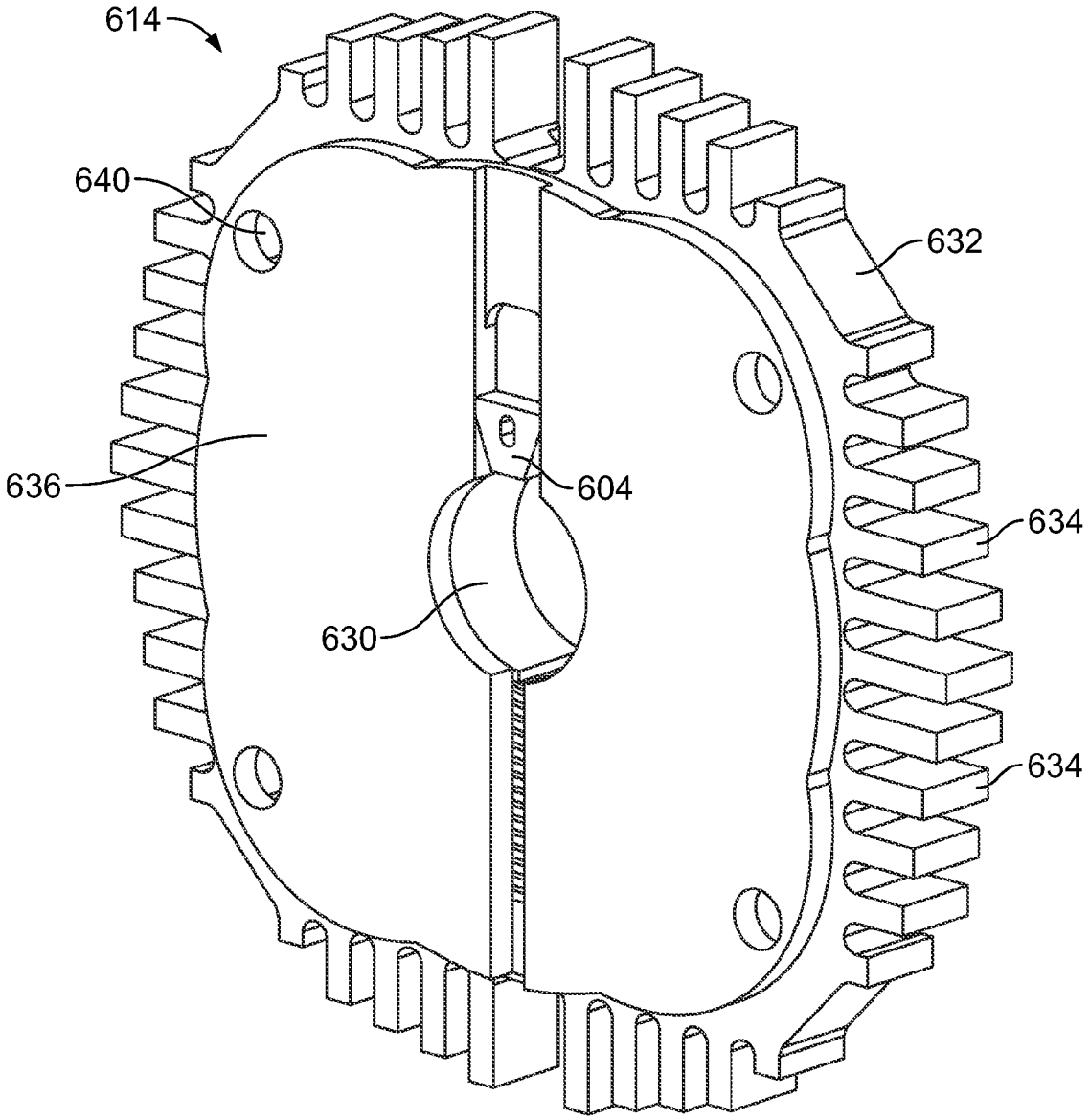
FIG. 9 depicts a perspective view of the example coil module of FIG. 8 with an example cooling plate.

The rivet gun depicted in FIGS. 6-7 is an air-cooled rivet gun constructed of fin-type heat sink clamps with cooling plates located between each coil module. In particular, FIGS. 6 and 7 illustrate example fans 626, 627, and 628 configured to cool the rivet gun and its components. These cooling fans direct air in direction 629, so as to cool the rivet gun and its components during operation. Further, the coil modules each include cooling fins, and cooling plates are located between the coil modules 614*a-h*. As shown in FIGS. 8-9, each coil module 614 includes coil 608 disposed between an inner coil housing 630 and an outer coil housing 632. The outer coil housing 632 includes a plurality of cooling fins 634. Further, a cooling plate such as cooling plate 636 (see FIGS. 6-7 and 9) is located between each coil module. Beneficially, the cooling plate absorbs heat from coil 608. FIGS. 8 and 9 also depict a plurality of holes in the coil module and the cooling plate, such as holes 638 and 640. These holes serve as holes for overbolts that are used to stabilize the coil modules 614*a-h* within enclosure 616 and housing plates 618 and 620.

3. Example Controller Components

Figure 3:
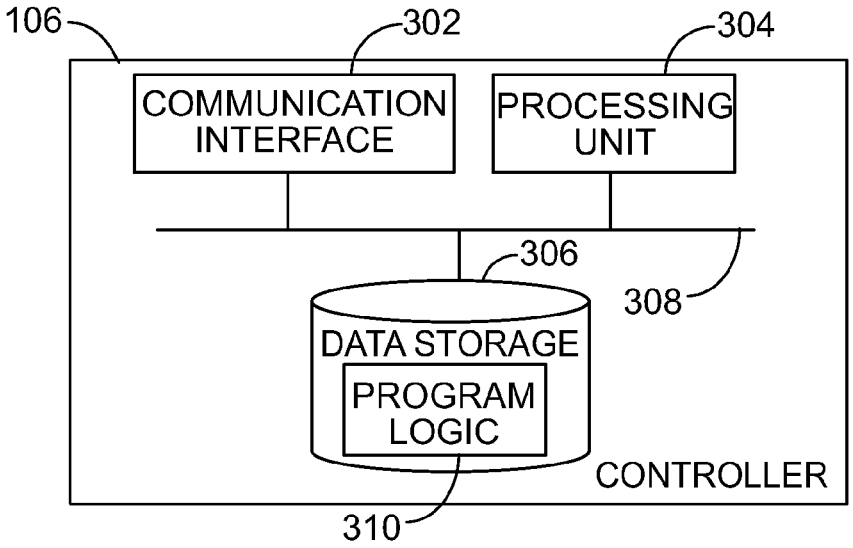
FIG. 3 is a simplified block diagram of a controller operable in a rivet system such as that depicted in FIG. 1.

FIG. 3 is next a simplified block diagram of a rivet-system controller showing some of the physical components that such an element may include. This block diagram represents controller 106 shown in FIG. 1 for instance.

As shown in FIG. 3, the controller 106 includes a communication interface 302, a processing unit 304, and data storage 306, all of which are communicatively linked together by a system bus, network, or other connection mechanism 308. With this arrangement, the communication interface 302 functions to provide for communication with various other rivet-system elements and may thus take various forms, allowing for wired and/or wireless communication for instance. Processing unit 304 comprises one or more general purpose processors (e.g., microprocessors) and/or one or more special purpose processors (e.g., application specific integrated circuits) and may be integrated in whole or in part with the communication interface. And data storage 306 comprises one or more volatile and/or non-volatile storage components, such as optical, magnetic, or flash memory and may be integrated in whole or in part with the processing unit. As shown, by way of example, data storage 306 comprises program instructions 310, which are executable by processing unit 306 to carry out various functions described herein.

In an exemplary embodiment, data storage 306 includes program instructions 310 that are executable to cause the rivet system 100 to: (i) position a rivet through a structure to be joined; (ii) position a first rivet gun on a first side of the rivet; (iii) position a second rivet gun on a second side of the rivet; and (iv) synchronize firing of the first and second rivet guns, so as to cancel forces that otherwise would propagate into the structure during installation of the rivet.

4. Example Operation

Figure 4:
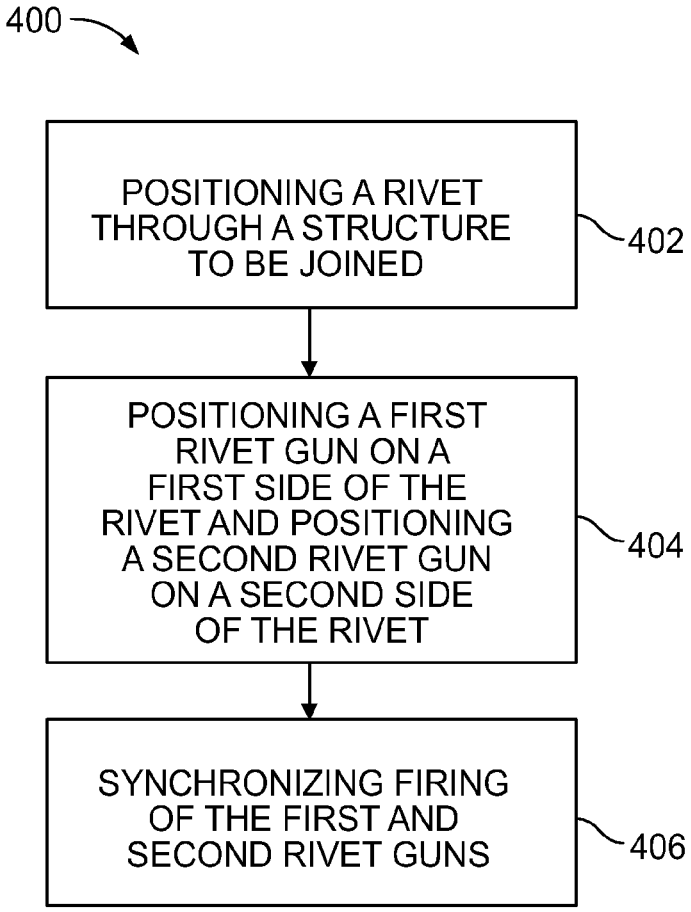
FIG. 4 is a flow chart depicting functions that can be carried out in accordance with an example method.

FIG. 4 is next a flow chart depicting a method 400 that can be carried out in accordance with the present disclosure. As shown in FIG. 4, at block 402, the method involves, positioning a rivet through a structure to be joined. The method also involves, at block 404, positioning a first rivet gun on a first side of the rivet and positioning a second rivet gun on a second side of the rivet. Further, the method involves, at block 406, synchronizing firing of the first and second rivet guns, so as to cancel forces that otherwise would propagate into the structure during installation of the rivet. In an example embodiment, these functions of method 400 are carried out by a rivet system such as rivet system 100 illustrated in FIG. 1. Further, the method 400 is carried out by a component or a combination of components of the rivet system 100.

i. Positioning the Rivet

Returning to FIG. 4, at block 402, rivet system 100 positions a rivet through a structure to be joined. For example, the rivet-placement apparatus 110 positions rivet 206 into rivet hole 204. In an example embodiment, the rivet-positioning apparatus 110 comprises one or more robotic arms that grip rivet 206 and move the rivet into the desired position. For instance, in an example, the rivet-positioning apparatus 110 is a gripper that includes mechanical fingers. Other examples are possible as well.

As indicated above, prior to positioning the rivet 206, the rivet system 100 forms the hole 204 into which the rivet is to be installed. For example, the rivet-hole-formation apparatus 108 forms the hole 204. This apparatus 108 is any suitable apparatus configured to form a desired hole, such as a drill or punching apparatus.

ii. Positioning the Rivet Guns

Returning to FIG. 4, at block 404, the rivet system 100 positions (i) first rivet gun 102 on a first side of the rivet 206 and (ii) second rivet gun 100 on a second side of the rivet 206. For example, as shown in FIGS. 2*a-b*, the first rivet gun 102 is placed at the head 220 of the rivet and the second rivet gun 104 is placed at the tail 222 of the rivet. In an example embodiment, the system 100 is configured such that the orientation of the rivet guns is adjustable so as to allow for a plurality of installation orientations. For example, the rivet guns 102, 104 are configured to adjust orientation based on the position of the rivet 206 and the position of the structure 202 to be joined. For instance, the rivet guns are configured to install a plurality of rivets at different locations on a curved structure. In an embodiment, the curved structure remains stationary throughout the installation process, and the orientation of the rivet guns 102, 104 are adjusted as necessary for each rivet. In another example, the rivet guns 102, 104 remain stationary throughout the installation process, and the rivet system 100 is configured to move the structure relative to the stationary rivet guns.

iii. Synchronizing the Firing of the First and Second Rivet Guns

At block 406, the rivet system 100 synchronizes firing of the first and second rivet guns 102, 104. In particular, the rivet system 100 synchronizes firing of the first and second rivet guns 102, 104 so that the first rivet gun 102 impacts the rivet 206 at substantially the same time as the second rivet gun 104 impacts the rivet. Beneficially, by synchronizing firing of the rivet guns, the rivet system 100 cancels forces that otherwise would propagate into the structure during installation of the rivet.

a. The First and Second Rivet Guns Impacting the Rivet a Plurality of Times

In an example embodiment, the first and second rivet guns 102, 104 are configured to impact the rivet 206 a plurality of times. For instance, in one embodiment the rivet gun is configured to impact the rivet 10-20 times. In another embodiment, the rivet gun is configured to impact the rivet 5-50 times. In yet another embodiment, the rivet gun is configured to impact the rivet less than 5 times or significantly above 50 times. By impacting the rivet 206 a plurality of times, it is possible to better control the interference during rivet installation. For example, when the rivet guns only impact the rivet a single time, it is extremely difficult to precisely control the deformation of the rivet and the interference, as well as the propagation of force throughout the system. However, by impacting the rivet a plurality of times and precisely controlling each impact, it is possible to precisely control the deformation of the rivet and the interference and to limit the propagation of forces throughout the system.

Figure 5A:
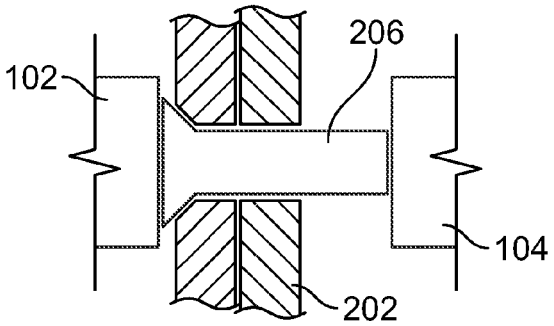
FIGS. 5*a-e* depict example stages of rivet installation in accordance with an example embodiment.
Figure 5B:
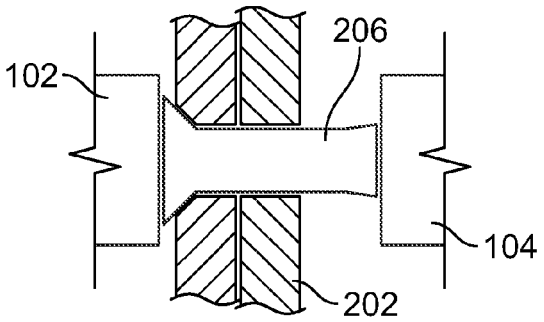
Figure 5C:
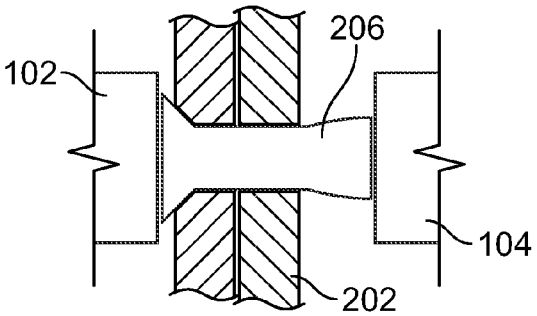
Figure 5D:
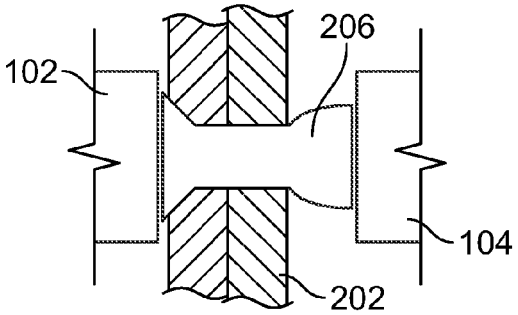
Figure 5E:
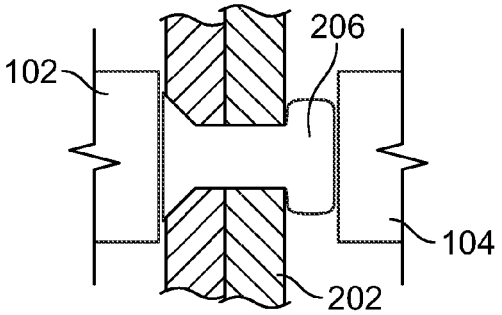

FIGS. 5*a-e* depict a rivet-installation process in which the rivet guns 102, 104 impact the rivet a plurality of times. These FIGS. 5*a-e* depict five different stages of the rivet installation process ranging from a beginning stage to a final stage. In particular, FIG. 5*a* depicts the rivet 206 after a first impact, FIG. 5*b* depicts the rivet after second impact, FIG. 5*c* depicts the rivet after a third impact, FIG. 5*d* depicts the rivet after a fourth impact, and FIG. 5*e* depicts the rivet after a fifth, final impact (after which the rivet is successfully installed). In an example, these five impacts are the only set of impacts used to deform the rivet 202. However, as mentioned above, fewer than five impacts or greater than five impacts are possible. Therefore, in another example, there are one or more impacts between each of the five depicted impacts.

As can be seen in FIGS. 5*a-e*, each impact serves to deform the rivet 206 so that the rivet eventually completely fills the rivet hole 204. By timing the impacts on each end, all of the energy of the rivet guns goes into deforming the rivet, and this deforms the rivet in a more controlled and more efficient fashion than would occur in the traditional rivet installation method using a rivet gun and bucking bar. Further, by precisely timing the impacts on each end, the opposing impacts cancel the forces or substantially all of the forces that would otherwise propagate into the structure. For instance, the opposing impacts cancel forces that would otherwise occur during a traditional rivet installation process (e.g., using a rivet gun and bucking bar).

b. Synchronizing the Impacts of the First and Second Rivet Guns to Occur at Substantially the Same Time In an example, synchronizing firing of the first rivet gun 102 and the second rivet gun 104 involves synchronizing each impact of the first and second rivet guns. As used herein, synchronizing each impact involves timing each impact of the first rivet gun so that it occurs at the same or substantially the same time as an impact of the second rivet gun. The impacts are precisely timed to minimize the amount of energy of the rivet guns dissipated throughout the system, so as to ensure that all or substantially all of the energy goes into deforming the rivet. Beneficially, this creates a highly controlled and efficient deformation process, while also reducing or eliminating forces that would otherwise propagate into the structure. In an example, the efficient deformation reduces the number of impacts used to form the rivet (e.g., since less energy is wasted by dissipation throughout the system). Additionally or alternatively, the efficient deformation allows the system to use lower energy impacts to deform a rivet than would otherwise be needed.

In an example, impacting the rivet at substantially the same time involves the rivet guns impacting the rivet within 0.1 microseconds to 10 microseconds of one another. In another example, impacting the rivet at substantially the same time involves the rivet guns impacting the rivet within 10 microseconds to 100 microseconds of one another. In another embodiment, impacting the rivet at substantially the same time involves the rivet guns impacting the rivet within 0.1-10 milliseconds of one another. In yet another embodiment, impacting the rivet at substantially the same time involves the rivet guns impacting the rivet within 100 milliseconds of one another.

In an example, the rivet being installed is an aluminum rivet. In aluminum, the speed of sound is approximately 5,100 meters/second, which is 0.2 inches/μs. Therefore, for a 1 inch aluminum rivet, an impact wave would take approximately 5 μs to travel from a first side to the opposite side of the 1 inch rivet. In this example, the rivet guns would impact the rivet within approximately 5 μs of each other. Other example rivet lengths and rivet materials (and thus speeds of sound through the material) are possible as well.

As mentioned above, when a rivet gun impacts rivet, an impact wave is sent through the rivet to the other side of the rivet. In order to precisely time the opposing impact to minimize the amount of energy of the rivet guns dissipated throughout the system and maximize the energy that is absorbed by the rivet itself, the rivet system 100 times the second impact created by the second rivet gun to occur at the same time or substantially the same time the impact wave created by the first rivet gun reaches the side at which the second gun is positioned. For instance, in an example, when rivet gun 102 impacts rivet 206 on the rivet head 220, an impact wave is sent through the rivet 206 to the rivet tail 222. At the same time or substantially the same time that the impact wave has reached the rivet tail 222, the second rivet gun 104 impacts the rivet tail 222.

By impacting the rivet tail 222 at the same time or substantially the same time as when the impact wave reaches that end, the second impact of the rivet gun 104 would create an impact that cancels the first impact wave traveling through the rivet. This allows for all or substantially all of the energy to go into deforming rivet 206, and thus reduces the amount of energy that would be dissipated elsewhere in the system (e.g., to the rivet gun 104 and/or the structure 202). As a result, the precisely-timed opposing impacts cancel forces that would otherwise propagate into the surrounding system (e.g., to the rivet gun 104 and/or the structure 202).

c. Precisely Controlling the Timing and Force of the Synchronized Impacts

In order to synchronize the firing of the rivet guns to cancel the forces that would otherwise propagate into the structure, the rivet guns 102, 104 are configured such that they impact the rivet at a precisely-controlled time with a precisely-controlled force. In an example embodiment, the first and second rivet guns 102, 104 are electromagnetic multi-stage rivet guns. In an example, an electromagnetic multi-stage rivet gun includes a firing tube that houses a projectile and is surrounded by electromagnetic coils. By controlling the movement of the projectile within the firing tube, the rivet gun precisely controls the timing and force of the impacts of the rivet gun.

In an example embodiment, the rivet gun is configured such that the firing-tube projectile acts upon a hammering apparatus at the end on its travel through the firing tube. In an example, the hammering apparatus is a spring-loaded hammer. In turn, after the projectile acts upon the spring-loaded hammer, the spring-loaded hammer is activated and acts upon the rivet with a set amount of force.

As mentioned above, FIG. 6 illustrates a cross section of rivet gun 104. The rivet gun includes firing tube 602 that includes projectile 606 and is surrounded by electromagnetic coils 608*a-h*. At the end of its travel through the firing tube 602, the projectile 606 acts on spring-loaded hammer 612, which in turn acts upon the rivet with a set amount of force.

The velocity of the projectile is thus a parameter that affects the impacts created by the rivet gun. For instance, the velocity of the projectile affects the force at which the rivet gun impacts the rivet. Further, the velocity of the projectile affects when the force of the rivet gun impacts the rivet. By controlling the velocity of the projectile in the firing tube, it is possible to precisely control the time and force at which the rivet gun (e.g., the spring-loaded hammer) impacts the rivet.

In an example, the velocity of the projectile is adjusted by controlling the current traveling through the various electromagnetic coils 608*a-h*. In particular, the current traveling through the electromagnetic coils 608*a-h* will produce a magnetic field, and this magnetic field imparts force that moves the projectile 606. The current traveling through the electromagnetic coils 608*a-h* is adjusted in order to precisely control the magnetic field that moves the projectile 606 through the firing tube 602. Therefore, in an example, synchronizing firing of the first and second rivet guns 102, 104 involves adjusting a velocity of the projectile in each rivet gun, so that the projectile in the first rivet gun and the projectile in the second rivet gun cause the rivet guns to impact the rivet at substantially the same time.

Further, in an example embodiment, in order to precisely control the velocity of the projectile 606, the current traveling through these coils 608*a-h* is adjusted based on a detected position of the projectile in each tube. In order to detect the position of the projectile 606 in the firing tube 602, the rivet guns 102, 104 include detectors that are configured to detect the position. For instance, in this example, the rivet gun includes a plurality of optical sensors configured to precisely detect the position of the projectile. FIG. 6 illustrates an example plurality of optical sensors 604*a-h*. These optical sensors detect the travel of the projectile 606 through the firing tube 602.

The rivet system 100 then controls firing of particular electromagnetic coils 608*a-h* in the rivet gun based on the detected projectile position. Since each rivet gun 102, 104 precisely detects the position of the projectile 606, the rivet system 100 controls the velocity of each projectile such that the projectiles in each gun act upon the rivet at the desired time. For instance, the rivet system 100 controls the velocity of each projectile such that the projectiles in each gun act upon the rivet at substantially the same time. In an example embodiment, magnetically stored energy is recycled into storage capacitors after each firing of the rivet guns. This energy recycling allows the rivet guns to turn minimal energy into waste heat.

d. Controlling Various Parameters of the Synchronized Impacts Based on the Structural Properties of the Rivet and/or the Structure Rivets come in a variety of different types of material, different shapes, and different lengths. Due to the different structural properties of rivets, different rivets often respond differently to the impacts of the rivet guns 102, 104. For example, a first rivet might deform more quickly under a given force than a second rivet would. Further, the rivet system 100 is used to install rivets in structures of different materials. For instance, the rivet system 100 will install rivets in aluminum structures, copper structures, steel structures, composite structures, and/or other material structures. Different materials have different structural properties, and thus rivet installation would impact different structures differently. For instance, composite materials are typically more sensitive to rivet installation than metallic structures.

Therefore, in an example embodiment, the rivet system 100 controls various parameters of the synchronized impacts based on the structural properties of the rivet being installed and/or based on the structural properties of the structure being joined by the rivet. These various parameters to control include, for example, the number of synchronized impacts, the force of the synchronized impacts, and the timing of the synchronized impacts.

The speed at which an impact wave travels through a rivet depends on both the force at which the impact occurs and the material properties of the rivet material. For example, an impact wave created by x amount of force on a steel rivet will take a different amount of time to reach the other end than would an impact wave created by x amount of force on an aluminum rivet. As another example, an impact wave created by y amount of force on a one inch rivet will take a different amount of time to reach the other end than would an impact wave created by y amount of force on a two inch rivet. Therefore, the rivet system 100 times the opposing impacts based on the force at which the impact occurs and the material properties of the rivet being installed. In practice, typically the time difference between the opposing impacts would be on the order of microseconds or milliseconds.

In an example embodiment, before installing a rivet such as rivet 206, the rivet system 100 selects predefined installation parameters for the rivet to be installed. As indicated above, these predefined installation parameters are selected based on properties of the rivet and/or the structure to be joined. For example, for a rivet of a given material and of a given length, the rivet system 100 selects (i) a particular number of times that the first and second rivet guns will impact the rivet, (ii) a particular force at which the rivet guns impact the rivet, and (iii) how far apart in time the opposing impacts of the first and second guns will be. The rivet system 100 selects appropriate timing for firing of the electromagnetic coils in each rivet gun, so as to achieve the preselected parameters of number of impacts, timing of impacts, and force of impacts. The rivet system 100 then carries out the predefined installation parameters by firing the electromagnetic coils at the preselected times.

In another example embodiment, the rivet system 100 uses feedback from the system to adjust the installation parameters during the installation process. For instance, the rivet system 100 adjusts the installation parameters based on the optical-sensor measurements of the projectile in the firing tube of the rivet guns. In an example, by measuring the precise position of the projectile of each rivet gun, the rivet system 100 adjusts the firing of the electromagnetic coils, so as to more accurately achieve the preselected parameters (e.g., force and timing of each impact). In another example, the rivet system monitors the progress of the rivet installation and the rivet system 100 then determines that parameters different from the pre-selected parameters are more appropriate for completing the installation. Therefore, the rivet system 100 then adjusts the selected parameters (e.g., force and timing of each impact) based on feedback from the rivet system (e.g., feedback from the optical sensors).

5. Example Benefit of the Disclosed Methods and Systems

The proposed methods and systems beneficially provide an improved way to install a rivet to join a structure, such as aircraft components. Beneficially, the disclosed methods and systems allow for precise control of interference during rivet installation. In the aerospace industry, structures joined by rivets go through many loading cycles throughout the life of the structure, and the quality of the rivet affects how the rivet and structure holds up during these loading cycles. Interference is a parameter that affects the useful life a rivet and/or the life of the structure joined by the rivet. Beneficially, by precisely controlling the interference during the rivet-installation process, the disclosed methods and systems thus help to extend the life of rivet and the structure being joined.

The disclosed methods and systems also beneficially reduce or eliminate the force that would otherwise propagate into the structure. Since the disclosed methods and system reduce or eliminate this force, the disclosed rivet methods and systems are suitable for joining composite materials. The traditional rivet process imparts forces on composite materials that make the traditional rivet process unsuitable for joining composite materials. However, the disclosed methods and systems allow for successfully securely join composite materials.

Still further, since the disclosed methods and systems allow for precise control of the interference, the disclosed methods and systems beneficially reduce the amount of human feedback used for the rivet-installation process. The traditional rivet-installation process often involves a large degree of human feedback during both the installation process and quality inspection process. However, given the precise control offered by the disclosed method and system, an inexperienced operator or a fully automated robot assembly system can deform rivets with a high degree of reliability to produce quality rivets consistently. By reducing or limiting the human feedback used for rivet-installation, the disclosed method and system beneficially increases the speed of the rivet-installation process and reduces costs involved with the rivet-installation process.

6. Conclusion

Exemplary embodiments have been described above. Those skilled in the art will understand, however, that changes and modifications may be made to these embodiments without departing from the true scope and spirit of the invention. The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

We claim:

1. A method for installing rivets, the method comprising:
positioning a rivet through a structure to be joined;
positioning a first rivet gun on a first side of the rivet;
positioning a second rivet gun on a second side of the rivet; and
synchronizing firing of the first and second rivet guns, wherein synchronizing firing of the first and second rivet guns comprises timing opposing impacts of the first and second rivet guns based on (i) a force at which the opposing impacts occur, (ii) structural properties of the rivet, and (iii) a speed of impact waves created by the opposing impacts, so that each opposing impact at a given side of the rivet occurs at substantially the same time as an impact wave caused by another opposing impact at the other side of the rivet reaches the given side of the rivet.

2. The method according to claim 1, wherein the first and second rivet guns are configured to impact the rivet with a plurality of opposing impacts, and wherein synchronizing firing of the first and second rivet guns comprises synchronizing the plurality of opposing impacts.

3. The method according to claim 2, wherein each rivet gun comprises a firing tube and a projectile within the firing tube, wherein a velocity of the projectile affects at least one of a force at which the rivet gun impacts the rivet and when the force of the rivet gun impacts the rivet, and wherein synchronizing firing of the first and second rivet guns comprises:
adjusting the velocity of the projectile in each rivet gun, so that the projectile in the first rivet gun and the projectile in the second rivet gun cause each opposing impact at a given side of the rivet to occur at substantially the same time as an impact wave caused by another opposing impact at the other side of the rivet reaches the given side of the rivet.

4. The method according to claim 3, wherein adjusting the velocity of the projectile in each rivet gun comprises:
utilizing optical sensors in each rivet gun to detect a position of the projectile within the firing tube; and
controlling firing of electromagnetic coils in the rivet gun based on the detected position of the projectile.

5. The method according to claim 3, wherein adjusting the velocity of the projectile in each rivet gun comprises:
controlling the velocity of the projectile in each rivet gun based on at least one of the structural properties the rivet or structural properties of the structure to be joined.

6. The method according to claim 3, wherein adjusting the velocity of the projectile in each rivet gun comprises:
adjusting the velocity of the projectile in each rivet gun, so that the projectile in the first rivet gun and the projectile in the second rivet gun cause the first and second rivet guns to impact the rivet within 100 microseconds of one another.

7. The method according to claim 1, wherein synchronizing firing of the first and second rivet guns comprises synchronizing firing of electromagnetic rivet guns.

8. The method according to claim 1, wherein positioning the rivet through the structure to be joined comprises positioning the rivet through a metallic structure or a composite structure.

9. The method according to claim 1, further comprising air-cooling the first and second rivet guns during installation of the rivet.

10. A riveting system comprising:
a first rivet gun;
a second rivet gun, said first rivet gun and said second rivet gun configured for operation on opposite sides of a rivet to be installed to join a structure; and
a controller, said controller configured to synchronize firing of the first and second rivet guns by timing opposing impacts of the first and second rivet guns based on (i) a force at which the opposing impacts occur, (ii) structural properties of the rivet, and (iii) a speed of impact waves created by the opposing impacts, so that each opposing impact at a given side of the rivet occurs at substantially the same time as an impact wave caused by another opposing impact at the other side of the rivet reaches the given side of the rivet.

11. The system according to claim 10, wherein the first rivet gun and the second rivet gun each incorporates a projectile within a firing tube, wherein the first rivet gun and the second rivet gun each comprise a plurality of optical sensors disposed with respect to said firing tube, said controller programmed to operate the first and second rivet guns based at least in part on a detected projectile position within said firing tube.

12. The system according to claim 11, wherein said controller is further programmed to operate said first and second rivet guns based at least in part on structural properties of the structure to be joined.

13. The system according to claim 11, wherein the first rivet gun and the second rivet gun each comprise a plurality of electromagnetic coils operable to cause movement of said projectile, said controller operable to apply signals to control firing of said electromagnetic coils based on the detected projectile position.

14. The system according to claim 10, wherein the first and second rivet guns are configured to impact the rivet with a plurality of opposing impacts, and wherein said controller is configured to synchronize the plurality of opposing impacts.

15. The system according to claim 10, wherein the first and second rivet guns are electromagnetic rivet guns.

16. A riveting system comprising:
a first rivet gun;
a second rivet gun, wherein said first rivet gun and said second rivet gun are arranged on opposite sides of a rivet to be installed to join a structure; and
a controller, wherein the controller is configured to cause the first and second rivet guns to impact the rivet a plurality of times, and wherein the controller is configured to control a timing of opposing impacts of the first and second rivet guns based on (i) a force at which the opposing impacts occur, (ii) structural properties of the rivet, and (iii) a speed of impact waves created by the opposing impacts, so that each opposing impact at a given side of the rivet occurs at substantially the same time as an impact wave caused by another opposing impact at the other side of the rivet reaches the given side of the rivet.

17. The riveting system of claim 16,
wherein the first rivet gun comprises a first firing tube and a first projectile within the first firing tube;
wherein the second rivet gun comprises a second firing tube and a second projectile within the second firing tube;
wherein a velocity of the first projectile affects at least one of a force at which the first rivet gun impacts the rivet and when the force of the first rivet gun impacts the rivet, and wherein a velocity of the second projectile affects at least one of a force at which the second rivet gun impacts the rivet and when the force of second first rivet gun impacts the rivet; and wherein the controller is configured to adjust the velocity of the first projectile in the first rivet gun and the velocity of the second projectile in the second rivet gun, so that the first projectile in the first rivet gun and the second projectile in the second rivet gun cause each opposing impact at a given side of the rivet to occur at substantially the same time as an impact wave caused by another opposing impact at the other side of the rivet reaches the given side of the rivet.

18. The system according to claim 17, wherein each of the first and second rivet guns further comprises a plurality of optical sensors disposed with respect to said firing tube, said controller programmed to operate said first and second rivet guns based on a detected projectile position within said firing tube.

19. The system according to claim 17, wherein said controller is programmed to adjust the velocity of the first projectile in the first rivet gun and the velocity of the second projectile in the second rivet gun based on at least one of the structural properties of the rivet or structural properties of the structure.

20. The system according to claim 16, wherein each opposing impact of the first rivet gun occurs within 100 microseconds of a respective opposing impact of the second rivet gun.

* * * * *